United States Patent [19]

Matsumoto et al.

[11] 4,106,449

[45] Aug. 15, 1978

[54] EGR SYSTEM

[75] Inventors: Noboru Matsumoto; Kunio Kurose, both of Toyota; Kinya Ueno, Seto, all of Japan

[73] Assignee: Toyota Jidosha Kogyo Kabushiki Kaisha, Japan

[21] Appl. No.: 736,192

[22] Filed: Nov. 15, 1976

[30] Foreign Application Priority Data

Jan. 20, 1976 [JP] Japan ..... 51-5690

[51] Int. Cl.[2] ..... F02M 25/06

[52] U.S. Cl. ..... 123/119 A; 123/191 A

[58] Field of Search ..... 123/119 A; 75/148; 138/DIG. 3, 141, 145; 251/368; 137/375; 428/36, 422

[56] References Cited

U.S. PATENT DOCUMENTS

| | | | |
|---|---|---|---|
| 2,724,672 | 11/1955 | Rubin | 138/DIG. 3 |
| 2,821,495 | 1/1958 | Dulin | 75/148 |
| 2,823,995 | 2/1958 | Blackmun | 75/148 |
| 2,907,103 | 10/1959 | Lewis | 138/DIG. 3 |
| 3,304,221 | 2/1967 | Eggleton | 428/422 |
| 3,420,262 | 1/1969 | Oneill | 137/375 |
| 3,563,785 | 2/1971 | Toshisaburo-Oga | 428/422 |
| 3,915,133 | 10/1975 | Nohira | 123/119 A |

FOREIGN PATENT DOCUMENTS

| | | | |
|---|---|---|---|
| 1,152,957 | 5/1969 | United Kingdom | 123/191 A |

*Primary Examiner*—Wendell E. Burns
*Attorney, Agent, or Firm*—Browdy and Neimark

[57] ABSTRACT

An EGR (exhaust gas recycling) system for diminishing the harmful substances of the exhaust gas from an internal combustion engine by recycling a portion thereof into the gas in-take side, comprises forming the EGR valve body and other essential parts of aluminum alloy castings and coating the portions thereof exposed to the exhaust gas with PTFE (polytetrafluoroethylene, e.g., Teflon). This phenomenally improves the corrosion-resistance and some other functions thereof.

10 Claims, 6 Drawing Figures

FIG. 1
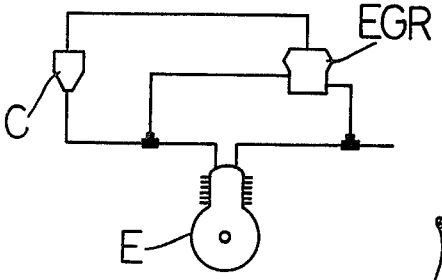
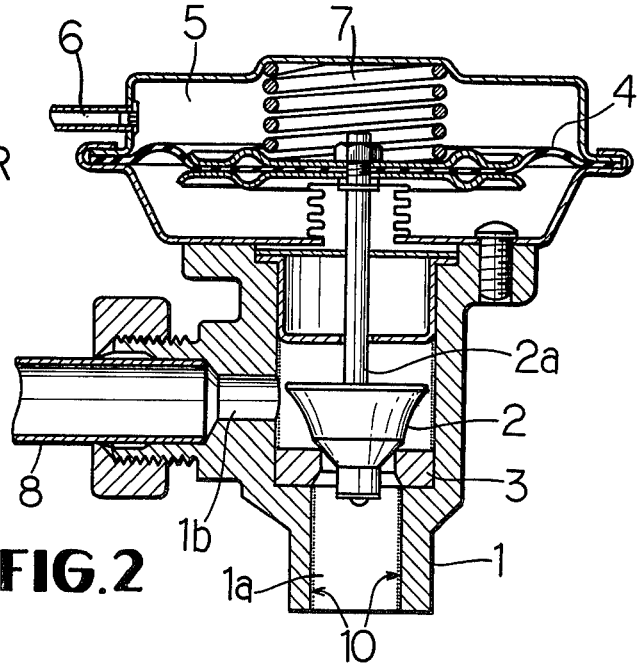
FIG. 2
FIG. 4
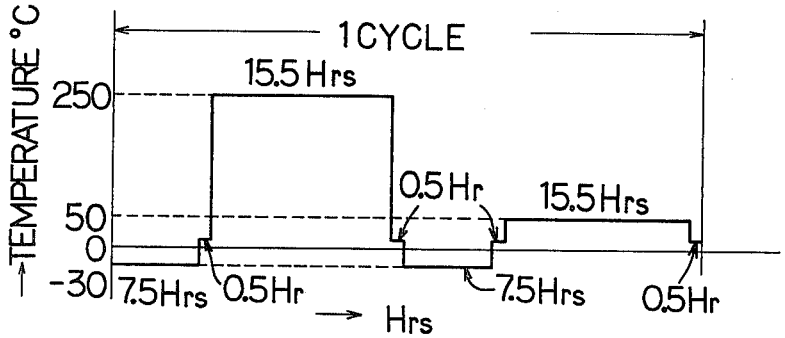
FIG. 6
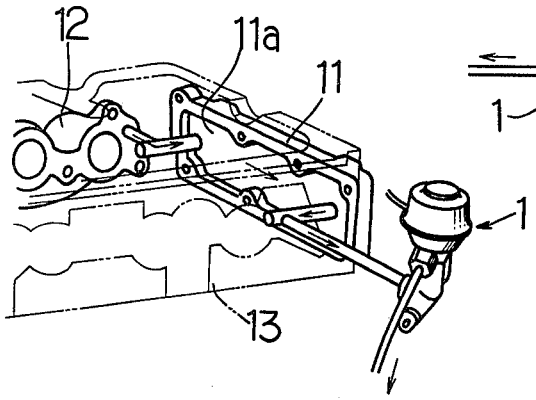
FIG. 5
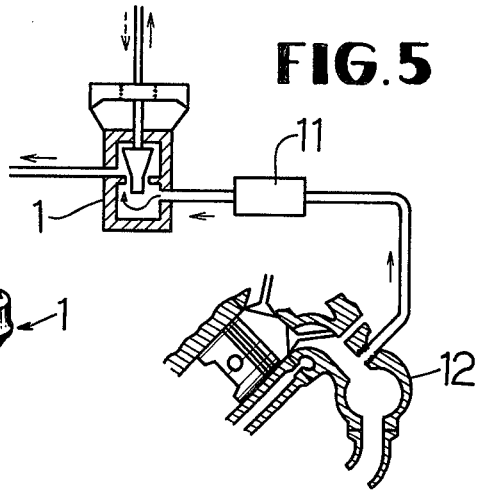

EGR SYSTEM

BACKGROUND OF THE INVENTION

The present invention relates to a so-called exhaust gas recycling apparatus of vehicles, which is referred to as EGR apparatus for short. More particularly it relates to a system wherein the EGR apparatus is made of an aluminum alloy which system is successful in against resisting against corrosion.

In an EGR system in accordance with this invention, a recycling method of the exhaust gas of an internal combustion engine into the gas in-take or suction side is adopted; the recycling system is so constructed that the degree of opening of an exhaust gas recycling valve (hereinafter simply referred to as an EGR valve) can be regulated depending on the intensity of the negative pressure producted in the carburetor.

Exhaust gas from the internal combustion engine generally contains, to say nothing of HC (hydro-carbon), CO, and/or $NO_x$ which are designated as sources of public nuisance or air pollution to be controlled, traces of other chemically active components. In the EGR system, through which extremely high temperature (normally 200° - 300° C) exhaust gases from the engine pass immediately after exit from the engine, the active components may cause acute chemical actions. Heat-resistance as well as corrosion-resistance are therefore required as essential features for the EGR system which is subjected to the abovementioned conditions. In the past when such EGR systems were made of ferrous materials, few problems occurred, since countermeasures therefor have been relatively easy to find. The recently prevailing requirements in the design of vehicles for lightening their weight has brought about a tendency of using light metals in the EGR system, at least in the EGR valve or exhaust gas cooler, which is comparatively great in weight. At first, various kinds of aluminum alloys were tried one after another, but all of them turned out after all to be susceptible to rapid corrosion. Effective measures for enhancing both heat-resistance and corrosion-resistance have been, although very hard, imminent requirements.

SUMMARY OF THE INVENTION

Considering the surrounding situation the invention is aimed at the solution of these knotty problems to succeed in the provision of an EGR system which is corrosion-resistant, heat-resistant, light in weight, low in cost, and workable in manufacturing processes. This invention has been accomplished by selecting aluminum alloys as the base material and applying an adequate coating thereon with PTFE, which proved very effective in maintaining a high degree of corrosion-resistance in the continuous use of the EGR system at a temperature of over 200° C.

It is an object of this invention to provide an EGR system made of Al-alloys in order to meet the requirement of lightening the weight of vehicles while effectively preventing corrosion by means of applying an adequate coating with PTFE over the portions exposed to the exhaust gas.

It is another object of this invention to improve some mechanical functions of the essential parts of the EGR system by preventing solid materials from sticking thereto.

It is still another object of this invention by investigating the causes of the corrosion, particularly pitting corrosion, in the EGR system to provide countermeasures for corrosion thereof.

These objects, as well as the various other novel features and advantages of this invention, will become apparent from the following description and the accompanying drawings.

DESCRIPTION OF THE DRAWINGS

FIG. 1 is a diagrammatic view of an embodiment of this invention;

FIG. 2 is a vertical sectional view of a member of the embodiment;

FIG. 4 is a graph showing the conditions for the heat treatment of the member shown in FIG. 2;

FIG. 5 is another diagrammatic view wherein a second member of the embodiment of this invention is employed; and FIG. 6 is an enlarged perspective view of the second member.

Figure 3:
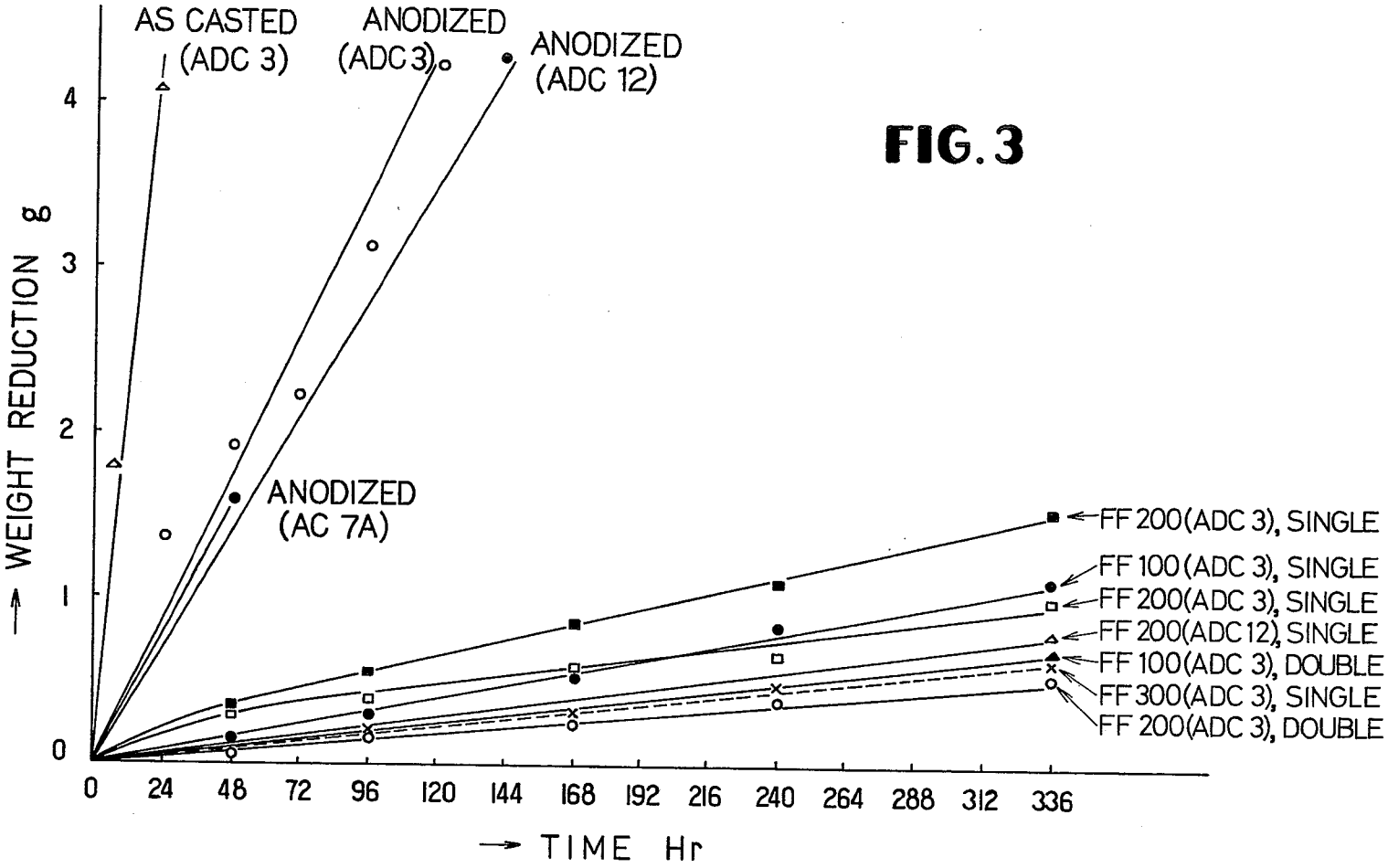
FIG. 3 is a graph wherein the data of tests against corrosion in accordance with the member shown in FIG. 2 are plotted.

Note (in FIG. 3):

SINGLE means SINGLE COATING.

DOUBLE means DOUBLE COATING.

ADC 3, 12 and AC 7A are Al-alloys specified in the Japanese Industrial Standard (JIS). The composition of these alloys are as follows:

| | Chemical Composition (%) | | | | |
|---|---|---|---|---|---|
| | Cu | Si | Mg | Zn | Fe |
| ADC 3 | <0.6 | 9.0 - 10.0 | 0.4 - 0.6 | <0.5 | <1.3 |
| ADC 13 | 1.5 - 3.5 | 10.5 - 12.0 | <0.3 | <1.0 | <1.3 |
| AC 7A | <0.1 | <0.3 | 3.5 - 5.5 | <0.1 | <0.4 |

| | Mn | Ni | Sn | Ti | Al |
|---|---|---|---|---|---|
| ADC 3 | <0.3 | <0.5 | <0.1 | — | Balance |
| ADC 13 | <0.5 | <0.5 | <0.3 | — | Balance |
| AC 7A | <0.8 | — | — | <0.2 | Balance |

DETAILED DESCRIPTION OF A PREFERRED EMBODIMENT

A first member of an embodiment:

This embodiment member is concerned with an EGR valve of a diaphragm type which is shown in FIG. 2, wherein a valve 2 and a valve seat 3 both of stainless steel are disposed in the valve body 1 made of a casting of an aluminum alloy. The reference numeral 4 denotes a diaphragm, chiefly made of flexible material, actuated by the pressure fluctuation in a chamber 5 that may be negative in pressure through a tubular path 6 communicating to the carburetor, which diaphragm opens and closes the valve 2 through the reciprocation of a valve rod 2*a*. The numeral 7 represents a spring member for biasing downwardly the valve rod 2*a* and the valve 2, to bias the valve 2 to the closed position.

The valve body 1 communicates with an exhaust gas pipe via an opening 1*a* and thereby can recycle the exhaust gas, by way of a tubular path 8 connected to an opening 1*b*, into the engine.

The valve housing is a casting of an aluminum alloy, the inside of which is coated with PTFE 10 at the whole internal surfaces exposed to the exhaust gas. The coating process is carried out by a well-known method wherein the binding-and-adhering ability has been raised through mixing a binder such as polyimide or polyamide. This coating will be hereinafter simply referred to as FF 100 in this description.

Another coating process is to coat PTFE after having performed the primer treatment, that is a first coating with a mixture of PTFE and an acid for example chromic acid, over the surface of the base material, and the coating will be hereinafter simply referred to as FF 200 in this description.

Still another coating process, which will be hereinafter simply referred to as FF 300, is to execute at first an etching process over the surface of the base material with caustic soda solution, to then coat the same surface about 0.5 $\mu$ thick with a mixture composed of 60% by weight PTFE powder and water, to dry the wet coating for 20 minutes at about 100° C, and then to bake the coated material for 20 minutes at about 380° C for finishing the PTFE layer. This coating process will be hereinafter simply referred to as FF 300 in the description.

Three samples of base material covered with coatings, respectively by the abovementioned three kinds of coating processes were tested in respect of their corrosion-resistance degree, by immersing them respectively in a later described saturated solution of lead (II) chloride. The etching earlier mentioned as a pre-treatment is to roughen the surface of the base material, so such etching may be substituted by a mechanical roughening method such as shot-blasting. The coated thickness of the PTFE ranging from 10 to 15 $\mu$ is experimentally sufficient for the purpose; even a double coating of double thickness gives almost unimproved effectiveness compared with a single coating of 10 – 15 $\mu$.

For sample tested, a casting of an aluminum alloy was heat-treated, in accordance with the conditions shown in FIG. 4, thereby considering the influence of residual stress or other causes therein. After having repeated three times a cycle which is composed of (1) leaving the sample for 7.5 hours at −30° C, (2) keeping it for 0.5 hour at room temperature, (3) maintaining it for 15.5 hours at 250° C, (4) remaining it for 0.5 hours again at room temperature, (5) keeping it for 7.5 hours at −30° C, (6) keeping it for 15.5 hours at 50° C, and (7) leaving it for 0.5 hour at room temperature, the test of corrosion-resistance was started. The concentration of the test solution was checked once per day by means of atomic absorption analysis and the degree of PH was also parallelly ascertained to determine whether it remained within the predetermined range. The experiment was carried out for 336 hours in a 60 l test solution at the temperature of 40° C ± 1° C.

The test which was executed as undermentioned proved phenomenal corrosion-resistance of the article in accordance with the invention. While keeping a saturated solution of lead (II) chloride $PbCl_2$, the solubility thereof being 0.18% by weight, at 40° C ± 1° C, a casting test piece of the same material as the valve body (the dimension of which is 30 × 40 × 2 mm 6480 g or 0.0155% weight reduction, i.e. far less than 0.02%) was immersed in the solution. Weight reduction in grams, set forth on the abscissa, in response to the lapse of time in hours, set forth on the ordinate, is shown as a graph in FIG. 3. What is evident from the above experiment is that a test piece not surface-treated, as it was cast, shows considerable weight reduction by corrosion, as much as more than 4 g within 20 hours, and even a test piece surface-treated with the well-known oxidation process (anodizing) was reduced in weight more than 4 g within 140 hours, while the test pieces in accordance with the present invention had weight reduction not more than 1.0 g even after the lapse of 330 hours.

As for the effect of the PTFE coating, three kinds of tests were carried out using each of FF 100, FF 200, and FF 300; with regard to the preceeding two tests, single and double coating were performed on each test piece, with little difference being observed therebetween regarding the corrosion-resistance. (FF 300 single coating falls between FF 100 double and FF 200 double.) The PTFE coating has been proved, in general, to be highly effective against corrosion incurred by $PbCl_2$ for the castings of aluminum alloys.

Additionally speaking, as an anti-knocking agent in the gasoline for the vehicle fuel, alkyl lead is effectual; any one of alkyl leads such as tetraethyl lead, tetramethyl lead, or mixed alkyl lead inevitably leads to some Pb and Cl in the fuel in the course of production. To say the least, it is quite common that in the exhaust gas thereof some $PbCl_2$ be detected; and the very existance of the $PbCl_2$ is infallibly an influential source of corrosion. This is why the abovementioned conditions were chosen as the corrosion test in the exhaust gas.

Reasons for which the embodiment turned out to be quite effective in the abovestated anti-corrosion test are deemed as follows:

(1) PTFE film has so high a degree of ductility, especially when heated, that it can comparatively easily follow the thermal deformation of the base material, an aluminum alloy, even when it is repeatedly exposed to the exhaust gas for a long time at more than 200° C just like in this experiment, scarcely being subjected to fatigue rupture or other similar phenomena.

(2) PTFE film has so high a degree of non-adhesiveness as well as corrosion-resistance, even when heated, that it prevents solid materials such as carbides accompanied by the exhaust gas from sticking to the contacting surface of the EGR valve, which results in its exhibiting a not negligible effect so that the EGR valve may be maintained in good operative conditions.

A second member of the embodiment:

In the EGR system another representative component instrument is an EGR cooler 11 shown in FIG. 5, which is located at the intermediate position of a tubular path connecting the exhaust manifold 12 of the engine and the EGR valve body 1, for cooling the exhaust gas. As a concrete example FIG. 6 shows the cooler 11 air-tightly disposed in the rear of the cylinder head 13; in the vacant space 11*a* of the cooler 11, which is cooled with water, the passing exhaust gas is cooled with the water cooling system, for preventing the diaphragm, rubber hoses, etc., from being damaged by heat. This EGR cooler 11 is, similarly to the first embodiment, made of a casting of an aluminum alloy and is subjected to the exhaust gas of higher temperature as it is located nearer to the engine than the EGR valve body. This means that the cooler is liable to be effected more severely, at least equally, by the corrosion than the EGR valve body; it is less affected, however, by carbides or others, because it is provided with no functional parts like a valve or a valve seat.

The cooler member of the EGR system in accordance with this invention was tested, in the same way as already described in detail, by immersing it in a hot solution of the above-mentioned $PbCl_2$ which is deemed similar to the atmosphere of the car exhaust gas, and it showed phenomenal corrosion resistance characteristics.

In the conventional tests for practical use of the parts in the EGR system of aluminum alloys, conspicuous corrosions, particularly a deep corrosion called "pitting," have been observed, causes therefor being too complex and delicate to be readily explained; common opinion or popular view says that the existence of $Cl^{31}$ as an anion under the condition that an extremely thin film is a passive state, of the thickness in the order of several tens A, is covering the surface of Al, and the addition of an oxidixing agent for raising the potential of the Al are essential factors for incurring the pitting corrosion. In addition, it is widely known that oxygen in a dissolved state acts as an influential factor for the corrosion phenomenon. The above described conditions are also applicable to the exhaust gas from the car gasoline engines acting on Al, aluminum alloys or Al-containing articles with anodized surface. Minute roughness or irregularity of the surface which is very common to metal castings is liable to become a core for the pitting corrosion, that is, a most susceptible condition thereto.

The PTFE film of this invention keeps all of the above-mentioned conditions in a negative state: (1) a thin film in a passive state which film may occasionally appear will be perfectly covered by the PTFE film to be almost inactive; (2) existence of the PTFE film will perfectly prevent or interrupt the contact of $Cl^-$ and the surface of the Al casting, if any $Cl^-$ exist; and (3) the PTFE film will nullify the rising of potential in Al, if any, and maintain it in an isolated condition. It is already recognized by scientists that the pitting corrosion will not occur when even any one factor of the above three is absent. The present invention is able to keep all the above factors in negative state, so there can be no possibility or likelihood of causing the pitting corrosion. If the principal cause of corrosion in the EGR system of an aluminum alloy casting should lie in the pitting corrosion, the reliability of the experiment to prove the excellent effect of the present invention can be said extremely high.

The effect of this invention may be summed up as follows: (1) an EGR system of Al-alloy casting applied coating with the PTFE film can keep sufficient corrosion-resistance even under exposure to the exhaust gas; (2) a practicable EGR system has thereby been obtained; and (3) the requirement for lightening vehicles has been satisfied at the same time.

It will be obvious to those skilled in the art that various changes may be made without departing from the scope of the invention and the invention is not to be considered limited to what is shown in the drawings and described in the specification.

What is claimed is:

1. In an EGR system for diminishing the harmful substances contained in the exhaust gas from an internal combustion engine by recycling a portion of the exhaust gas into the gas in-take side of the engine, said EGR system comprising a valve body and an EGR cooler, the improvement wherein each is made of a casting of an aluminum alloy, with at least the portions of the inside thereof exposed to the exhaust gas being coated with means for improving the corrosion-resistance and function of the EGR valve, for eliminating pitting, and for inhibiting the sticking of solid particles thereto, said means comprising a PTFE coating having a layer thickness of 10 – 15 $\mu$.

2. An EGR system as set forth in claim 1, wherein other component members than said EGR valve and said cooler are, at least at the portions exposed to the exhaust gas, coated with PTFE.

3. An EGR system as set forth in claim 1, wherein said PTFE is applied as a double layer coating.

4. An EGR system as set forth in claim 1, wherein said aluminum alloy is a die casting alloy containing at least Si ranging from 9.0 to 12.0 wt%.

5. An EGR system as set forth in claim 1, wherein said coating is provided by applying polytetrafluoroethylene mixed with a binder of polyimide or polyamide.

6. An EGR system as set forth in claim 1, wherein said coating is provided by applying polytetrafluoroethylene mixed with chromic acid.

7. An EGR system as set forth in claim 1, wherein said coating is applied by etching said inside portions, coating with polytetrafluoroethylene-water mixture, drying, and then baking for about 20 minutes at about 380° C.

8. An EGR system as set forth in claim 1, wherein both said EGR valve body and said cooler can be immersed in a solution of $PbCl_2$ at about 40° C for 300 hours with reduction of weight by corrosion being less than 0.02%.

9. The new use of PTFE as a 10 – 15 $\mu$ coating for the exhaust gas contacting surfaces of an EGR cooler, said cooler being formed of cast aluminum.

10. The new use of PTFE as a 10 – 15 $\mu$ coating for the exhaust gas contacting surfaces of an EGR valve body, said valve body being formed of cast aluminum and having a valve element therein actuated by means for sensing gaseous pressure.

* * * * *